US008327659B2

(12) United States Patent
Winkler et al.

(10) Patent No.: US 8,327,659 B2
(45) Date of Patent: Dec. 11, 2012

(54) INSULATED COOLER

(75) Inventors: David R. Winkler, St. Louis, MO (US); Phillip B. Rideout, Valley Park, MO (US)

(73) Assignee: Cooler by Design, St. Louis, MO (US)

( * ) Notice: Subject to any disclaimer, the term of this patent is extended or adjusted under 35 U.S.C. 154(b) by 1036 days.

(21) Appl. No.: 12/331,135

(22) Filed: Dec. 9, 2008

(65) Prior Publication Data

US 2010/0005827 A1 Jan. 14, 2010

Related U.S. Application Data

(60) Provisional application No. 61/080,419, filed on Jul. 14, 2008.

(51) Int. Cl.

| | |
|---|---|
| ***F25D 3/08*** | (2006.01) |
| ***F25D 3/06*** | (2006.01) |
| *A47J 41/00* | (2006.01) |
| *B65D 81/38* | (2006.01) |

(52) U.S. Cl. ..... 62/457.7; 220/592.25

(58) Field of Classification Search ..... 62/457.7; 220/592.25

See application file for complete search history.

(56) References Cited

U.S. PATENT DOCUMENTS

| | | | | |
|---|---|---|---|---|
| 1,468,198 | A | 9/1923 | Dunn, Jr. | |
| 2,402,967 | A * | 7/1946 | Lubenow | 451/33 |
| 2,457,043 | A * | 12/1948 | Histand | 220/592.2 |
| 2,584,254 | A | 2/1952 | Brodbeck | |
| 2,919,829 | A | 1/1960 | Forrer | |
| 3,777,418 | A * | 12/1973 | Cooper | 434/425 |
| 4,274,267 | A | 6/1981 | James | |
| 4,372,453 | A * | 2/1983 | Branscum | 215/12.2 |
| 4,449,761 | A | 5/1984 | Davis | |
| D325,493 | S | 4/1992 | Hicks | |
| D349,630 | S | 8/1994 | Redmon | |
| D369,524 | S | 5/1996 | Gunter, II | |
| 5,523,273 | A * | 6/1996 | McQuaide | 503/227 |
| 5,531,242 | A * | 7/1996 | Paganessi | 137/255 |
| D378,562 | S | 3/1997 | Miller | |
| D386,649 | S | 11/1997 | Arnfelt | |
| 5,718,336 | A * | 2/1998 | Haarlander | 206/542 |
| 5,803,266 | A | 9/1998 | Blackwelder | |
| 6,073,449 | A * | 6/2000 | Watanabe et al. | 62/3.2 |
| 6,209,346 | B1 * | 4/2001 | Frosch | 62/457.7 |
| 6,269,966 | B1 * | 8/2001 | Pallo et al. | 220/592.25 |
| 6,347,706 | B1 | 2/2002 | D'Ambrosio | |
| 6,471,059 | B2 | 10/2002 | Purvis | |
| 6,861,116 | B2 * | 3/2005 | Emmert | 428/40.1 |
| 7,032,753 | B2 | 4/2006 | Purvis | |
| 7,040,115 | B1 | 5/2006 | Lopez et al. | |

(Continued)

OTHER PUBLICATIONS

Wikipedia article Sublimation printing retrieved on Dec. 15, 2011.*

(Continued)

*Primary Examiner* — Ljiljana Ciric
*Assistant Examiner* — Alexis Cox
(74) *Attorney, Agent, or Firm* — Senniger Powers LLP

(57) ABSTRACT

A cooler is particularly configured for application of any selected design or marking. Any design may be easily applied to a standard cooler configuration. The design can be protected with a cover. The cooler also has structure for ease of mounting to different objects, and can be readily stacked. The lid can selectively retain cold or warm packs to cool or heat the interior.

19 Claims, 21 Drawing Sheets

U.S. PATENT DOCUMENTS

| | | | | |
|---|---|---|---|---|
| 2001/0035366 | A1 | 11/2001 | Purvis | |
| 2002/0108279 | A1* | 8/2002 | Hubbard et al. | 40/312 |
| 2006/0289428 | A1 | 12/2006 | Longua | |
| 2008/0156815 | A1 | 7/2008 | Coff | |
| 2008/0179847 | A1 | 7/2008 | DeFrancia | |
| 2010/0078451 | A1* | 4/2010 | Mount | 224/148.3 |
| 2010/0236974 | A1* | 9/2010 | Pedrazzi et al. | 206/542 |
| 2010/0263399 | A1* | 10/2010 | Pollina et al. | 62/331 |
| 2011/0100044 | A1* | 5/2011 | Reichert et al. | 62/246 |

OTHER PUBLICATIONS

Product Engineering and Manufacturing Second Edition Linda C. Schmidt, Guangming Zhang, Jeffrey W. Herrmann, George Dieter, Patrick F. Cuniff College House Enterprises, Knoxville, Tennessee, 2002 pp. 104-105.*

* cited by examiner

INSULATED COOLER

CROSS-REFERENCE TO RELATED APPLICATIONS

This is a non-provisional of U.S. application Ser. No. 61/080,419, filed Jul. 14, 2008, the entire disclosure of which is incorporated herein by reference.

FIELD OF THE INVENTION

The present invention relates generally to insulated coolers, and more specifically it pertains to improvements in cooling efficiency, guarded display panels and mounting brackets for such coolers.

BACKGROUND OF THE INVENTION

Over the years many advances have been made in portable insulated coolers for various product uses and with increasing attention to outer esthetic appearance. The focus has been to provide such coolers with a recognizable exterior identity, such as name and/or logo of a business, school, family, club or other association. Amateur and professional sports activities and participants are particularly popular subjects for an identity panel or appliqué of some type. Such light-weight portable coolers (frequently called "sports coolers") have been designed to prominently display a name, logo or image that appeals to large numbers of buyers/users. Attempts have been made to offer change-over panels or interchangeable lids to alter the identity association base and thereby provide a multiple association for the same cooler. However, the prior coolers have failed to offer an acceptable display or one that is guarded or protected by a cooler reinforcement or structural covering.

Attempts to overcome one problem or address one objective frequently reduces the practicality of other features and objectives important in the cooler art as is the case with other products in other fields. For instance; some important considerations are "stackability" to facilitate warehousing and off-season storage; "mountability" to accommodate a vehicle or wall surface attachment for safe and convenient usage; and "coolability" which is a term indicating the capacity and ease of cooling the product zone and maintaining temperatures therein.

SUMMARY OF THE INVENTION

In one aspect of the present invention, an insulated cooler generally comprises a main cooler body having multiple side walls and a bottom wall forming a product container with a top opening. A lid is constructed and arranged for selectively covering the top opening. At least two of said multiple side walls are adjacent to each other, and each of said adjacent side walls has a design zone thereon. A design panel system has an inner side portion next to the side wall design zone and an outer side portion comprising a protective shielding cover for the inner design portion.

In another aspect of the present invention an insulated container generally comprises a main cooler body having side walls and a bottom wall forming an internal container cavity for holding products, and a lid to selectively enclose the container cavity. A design panel affixed to one of the side walls of the container has a design thereon. A shield comprising at least one frame element removably mounted on the container and covering an edge margin of the design panel affixed to the container side wall.

These and other objects and features will be in part apparent and in part pointed out hereinafter.

BRIEF DESCRIPTION OF THE DRAWINGS

In the accompanying drawings which form a part of this specification and wherein like numerals refer to like parts wherever they occur.

Corresponding reference characters indicate corresponding parts throughout the several views of the drawings.

DEFINITIONS

The following definitions will be applicable in the construction and interpretation of the following description of the invention and the appended claims.

"cooler" as used herein means an insulated box or container for holding products, such as bottled or canned beverages, and keeping such products at cooled or heated temperatures.

"design" means any word, phrase, name, logo, letter, symbol, pattern, color, graphic, scene, picture or the like imagery.

"design panel" means a panel sheet, ply or layer of material forming a design or having a design applied thereto.

"design panel system" includes the combination of a design panel and an outer shield covering at least a portion of the underlying design panel, but also includes either the design panel or outer shield individually.

"design zone" means a predetermined designated area of a cooler side wall that is constructed and arranged to have applied thereto a design panel or a design panel system or a wrap-around panel.

"wrap-around panel" means an outer covering and/or a design panel that is bent around or turns the corner between adjacent or contiguous side walls or side wall sections of a multi-sided cooler.

"outer overlaying panel" means a panel, wall or sheet that covers a substantial portion of an outside structural wall surface "coolant packet" and "coolant pack" means a sealed container of predetermined size holding a quantity of freezable (or heatable) chemical-gel or like material that functions to refrigerate or heat.

"mounting surface" means any structure capable of attaching a supporting mounting bracket for a cooler; and "surface mounting" refers to the attachment of a bracket and/or cooler to such mounting surface.

"vehicle" means all types of highway and off-road conveyance and/or movable equipment for transportation, agriculture, commerce, industry, entertainment, sports, domestic and other purposes, and generally any structure on which the operator/user may want to surface mount a cooler for ready access.

DESCRIPTION OF THE PREFERRED EMBODIMENTS

Figure 1A:
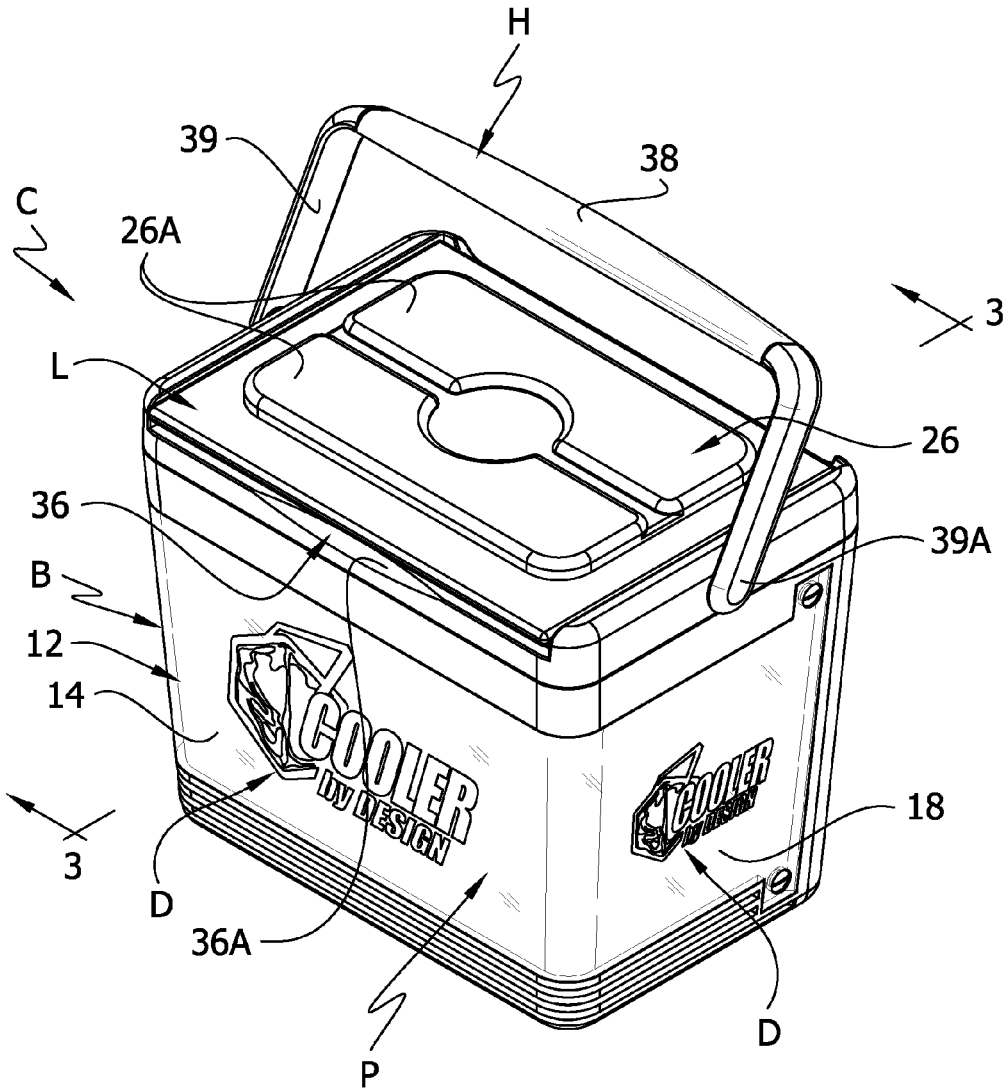
FIG. 1A is a perspective view of an insulated cooler of a first embodiment, including cooler body, lid and a handle shown in cooler carrying position.
Figure 1B:
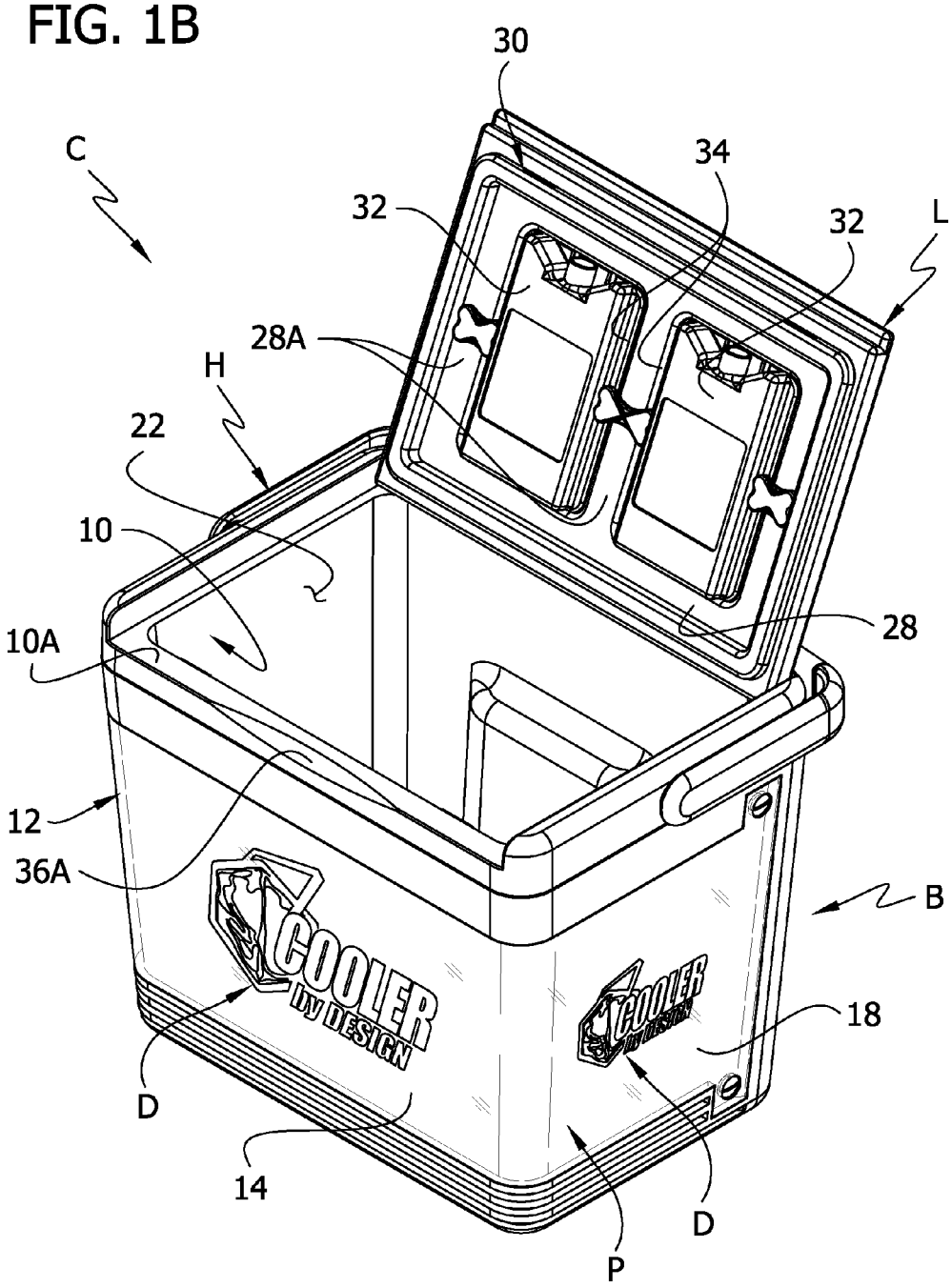
FIG. 1B is a similar view of the cooler, but shown in an open position with the lid raised.
Figure 2A:
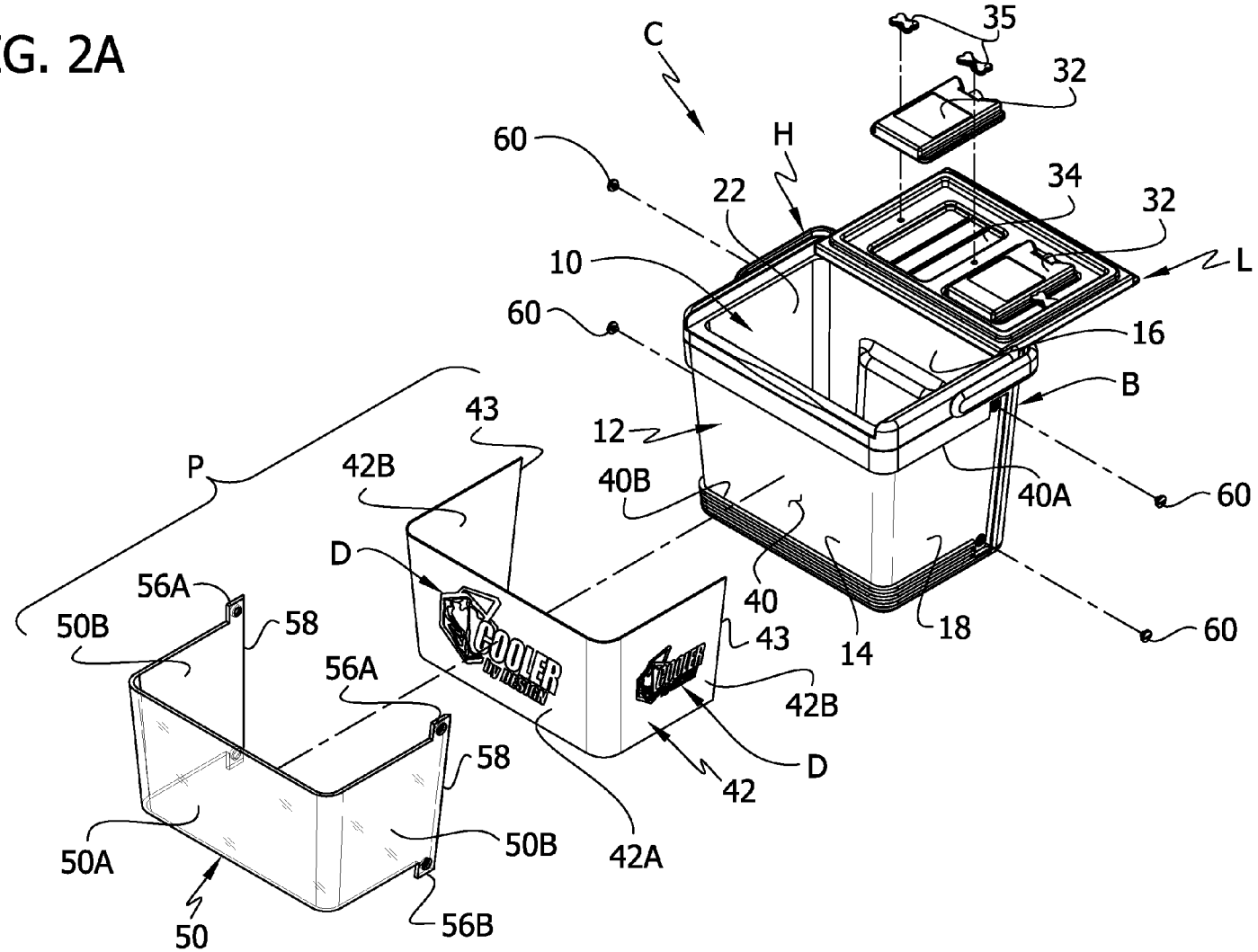
FIG. 2A is an exploded perspective view of the first cooler embodiment.
Figure 2B:
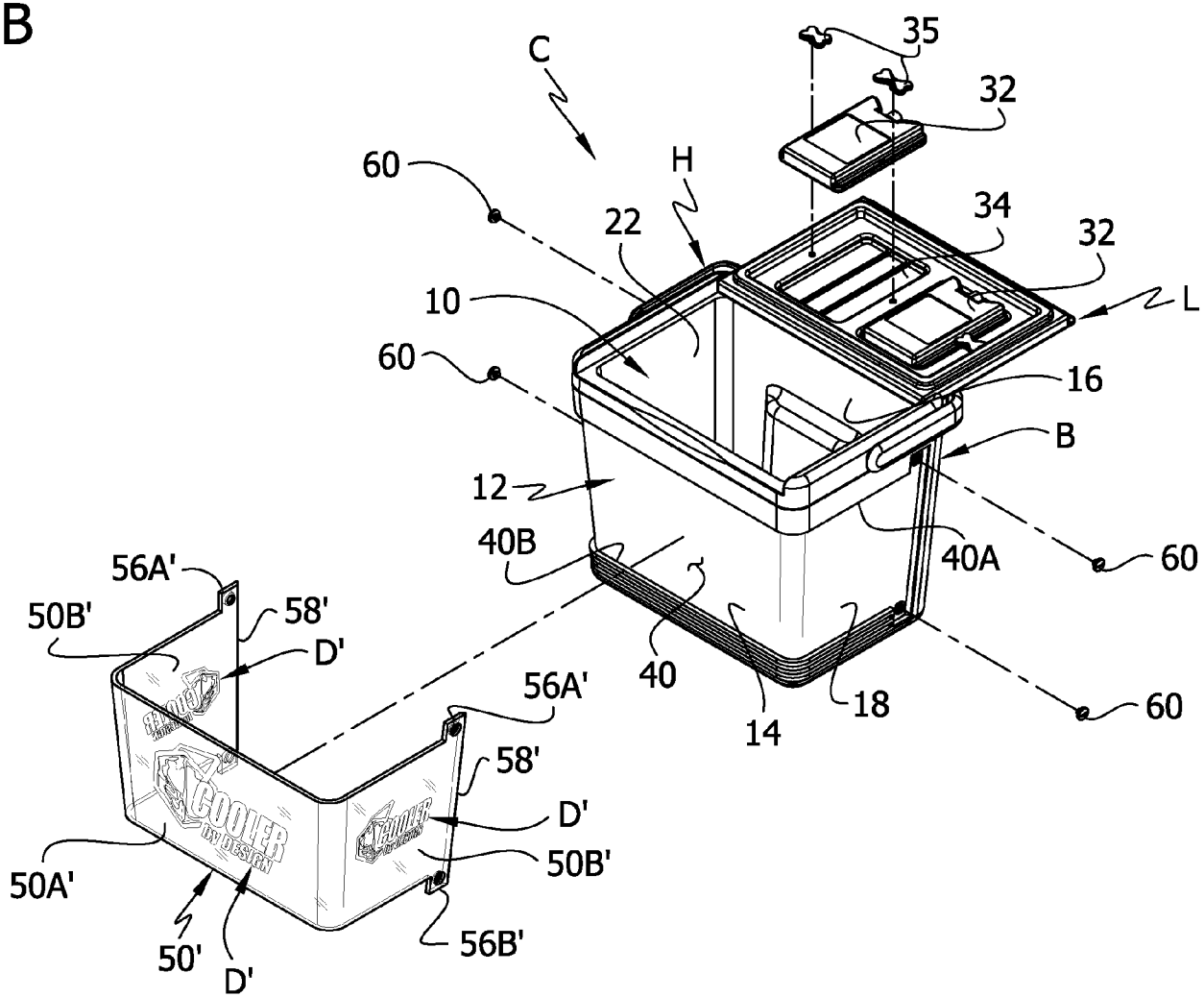
FIG. 2B is an exploded perspective view similar to FIG. 2A, but showing a modified design panel system.
Figure 3:
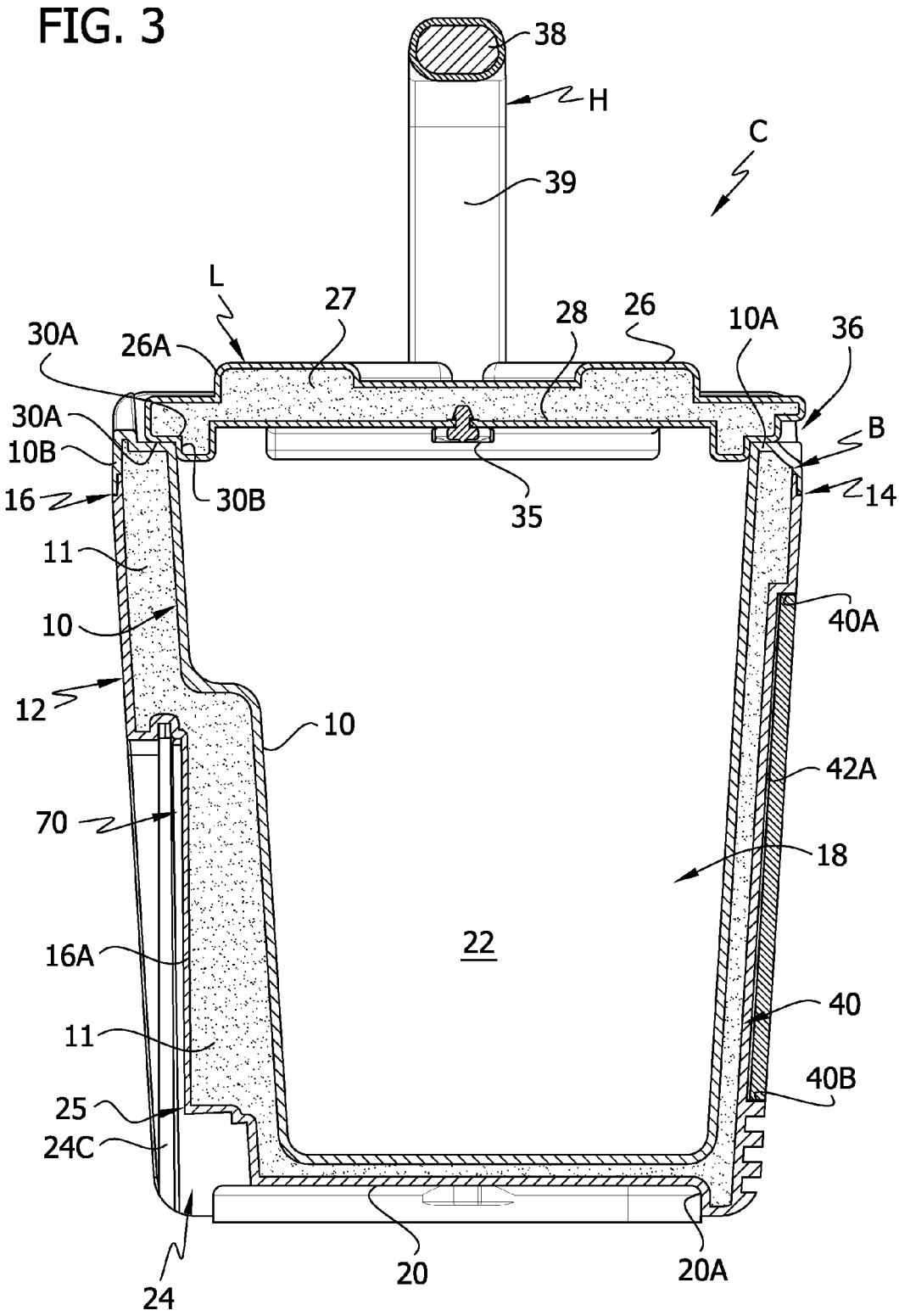
FIG. 3 is an enlarged cross-sectional view of the cooler taken substantially along line 3-3 of FIG. 1A.

Referring to FIGS. 1A through 6, a presently preferred embodiment of the invention comprises an insulated cooler C having a main cooler body B, a lid or top cover L hinged to the body B and a handle H also operably connected to the cooler body. The main body B of the cooler typically is formed with assembled inner and outer casing shells 10 and 12 (FIGS. 2A and 3) having an insulation material 11 located therebetween. The body B includes a front side wall 14, an opposed rear side wall 16, opposed end side walls 18 and a bottom wall 20 defining an interior container well or chamber 22 for holding products (not shown) to be cooled. FIG. 3 best shows the assembled inner and outer shells 10 and 12. The inner shell 10 has an out-turned horizontal top rim 10A with a depending vertical flange 10B that mates with the top edge of the outer shell 12.

Figure 5:
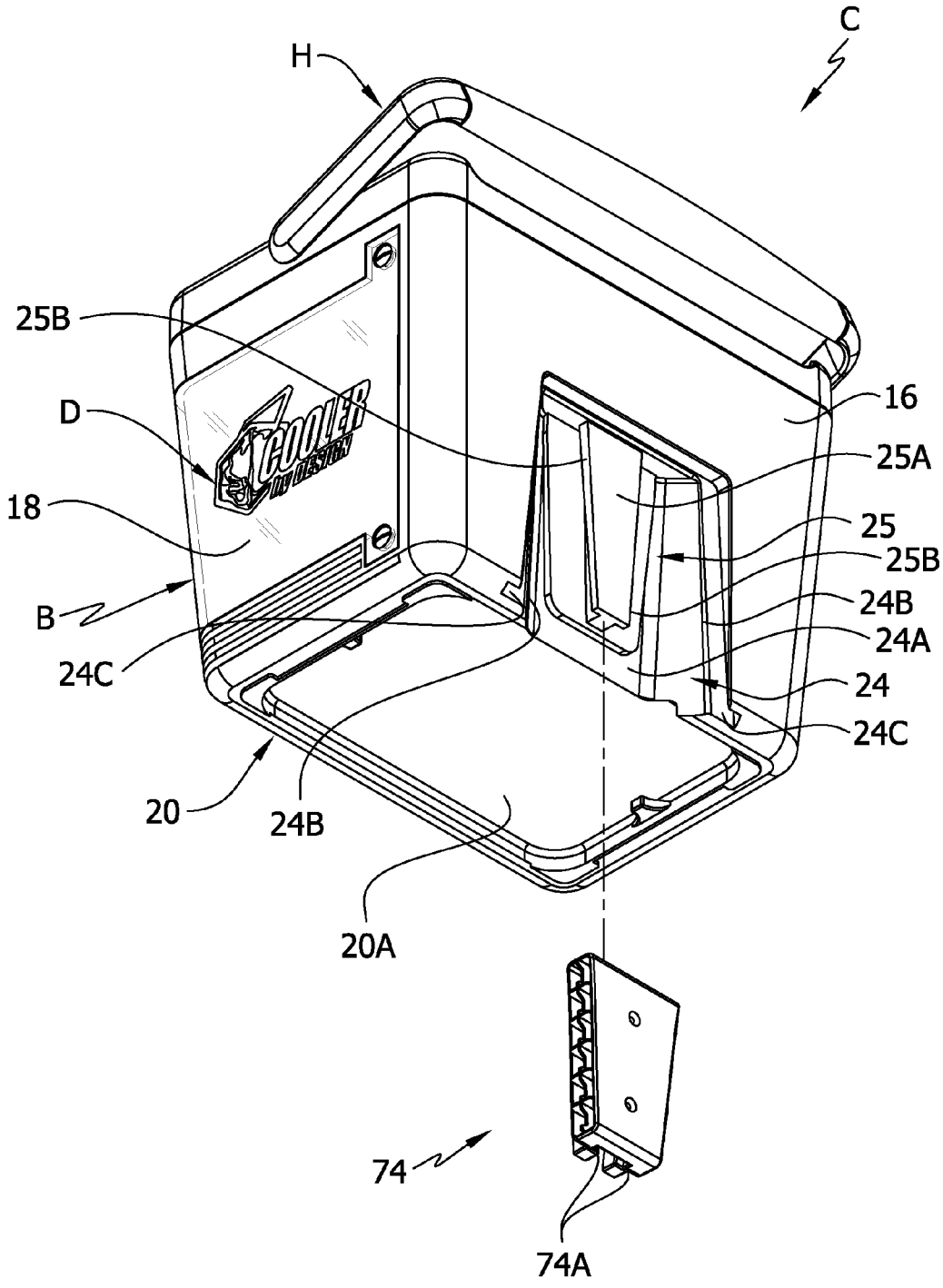
FIG. 5 is a perspective view of the back of the cooler body and showing one form of mounting bracket adapter for the cooler in an exploded position.

Referring to FIG. 5, the rear or back wall 16 is formed with a central outwardly-opening chamber 24 extending upwardly from the bottom wall 20 and being constructed as part of a cooler-mounting system or assembly that can selectively accommodate different mounting bracket arrangements to be described. The rear wall chamber 24 has a vertical wall 24A spaced into the cooler body from the outer surface of the rear wall 16 by lateral side walls 24B, which form vertical channels 24C behind the outer surface of rear wall 16 along the access opening to the chamber 24. The rear wall 16 includes a mounting block (or "track") 25 in the recessed chamber 24 having an outward facing surface 25A for use in mounting the cooler, as will be explained in more detail hereinafter.

Figure 4:
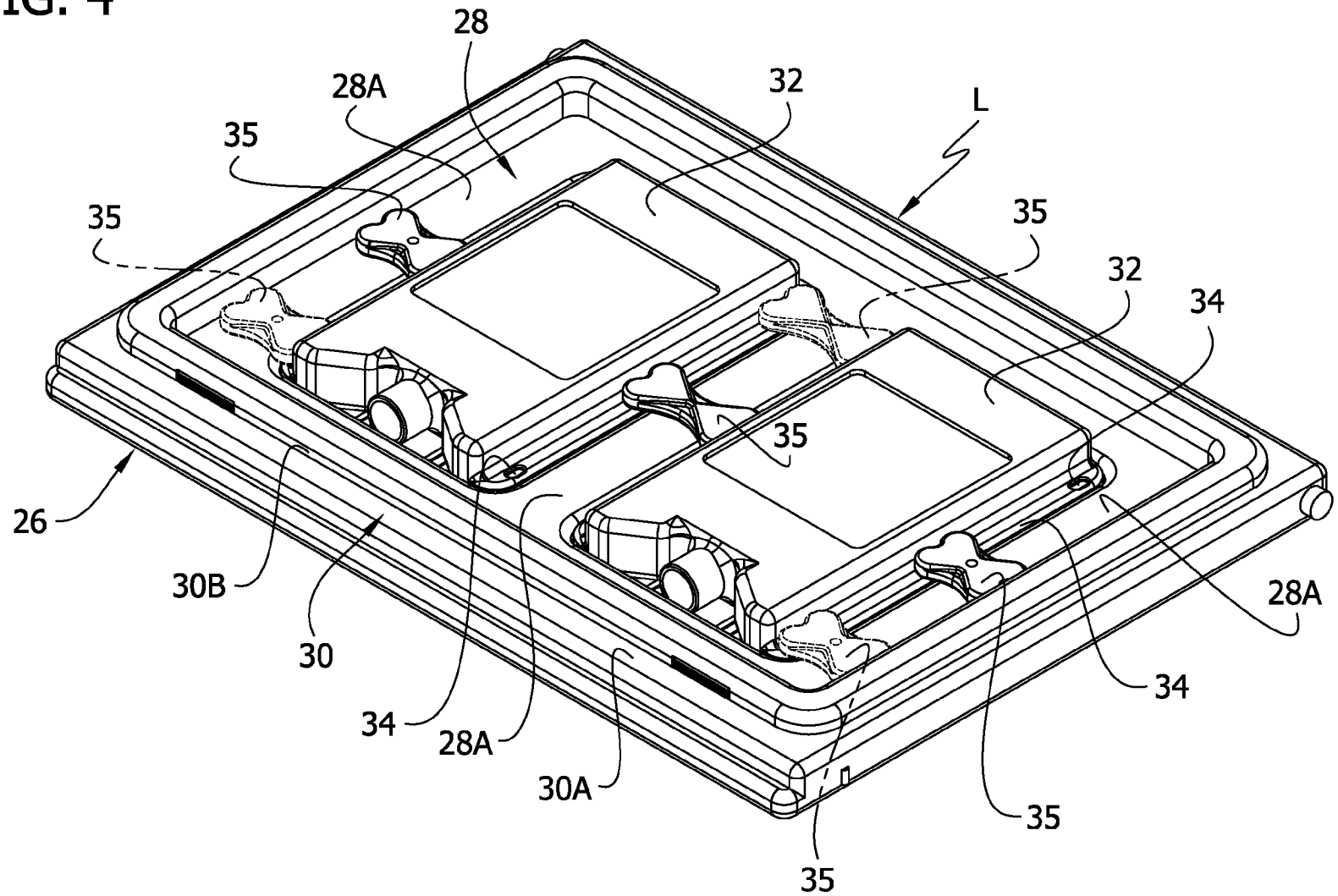
FIG. 4 is an enlarged perspective view of the inside of the cooler lid of FIG. 1B and showing coolant packets therein.

The lid L is also comprised of spaced upper and lower shells 26, 28 and insulation 27 therebetween (see FIG. 3). The lower shell 28 is contoured with a stepped outer peripheral wall forming an edge section 30 having horizontal rib-sealing lip 30A to fit against and around the rim opening 10A of the main body B, and a vertical wall section 30B to extend downwardly within the container cavity 22 and sealingly abut against the upper vertical sidewall portion of the inner shell 10. The lid L is also constructed and arranged with one or more pockets or recesses 34 to accommodate the placement of coolant packets 32, which in this embodiment are pre-frozen for use and function as frozen gel or "ice" packs 32 to provide a dry cooling source for the cooler cavity 22. As shown in FIGS. 1B, 2A and 4, a pair of coolant packs 32 are placed in the lid sockets 34 and held in place by bow-tie fasteners 35 or the like, which are swivelly mounted at strategic locations on the lower shell 28, as in spaced pairs on lower shell ribs 28A on opposite sides of the sockets 34. The upper shell 26 may also be contoured to accommodate ice packs 32 and insulation (not shown). It may be desirable to provide outwardly and upwardly projecting raised areas or embossments 26A on the upper wall of the lid L to fit or meet with complementary recessed areas 20A or indentations in the bottom wall 20 whereby multiple coolers of the same construction may be conveniently stacked to interfit with each other without sliding laterally. The cooler C has a lid-lifting access slot 36 at the top of the front side wall 14, which is sculpted at the central margin of its side wall with a depressed area 36A. When the lid L is closed, its horizontal lip 30A opposed to the depressed area 36A defines the access slot 36 that facilitates direct upward finger control in raising the lid.

The handle H is configured for comfort in carrying and convenience in use. It has a main hand-bar 38 preferably made of rubber or a like substance to be soft and secure when carried, yet solidly supporting the weight of a loaded cooler. The side bars or straps 39 are hinged (at 39A) to the end side walls 18 to permit the handle to be lifted up for use (FIG. 1A) or folded to the front or back (FIG. 1B) for storage or access to use the cooler. Other constructions of the handle are permitted within the scope of the present invention, or the handle may be omitted.

A feature of the preferred embodiment of the invention resides in the features of the guarded multiple display panel system, as seen best in FIGS. 1A, 1B, 2A, 3 and 5, which show a continuous outer overlaying and wrap-around panel system P covering a substantial portion of at least two adjacent side walls of the cooler. In the preferred embodiment, the panel system P is three-sided and extends across the front side wall 14 and both end side walls 18 of the cooler C, as will now be described.

Figure 6:
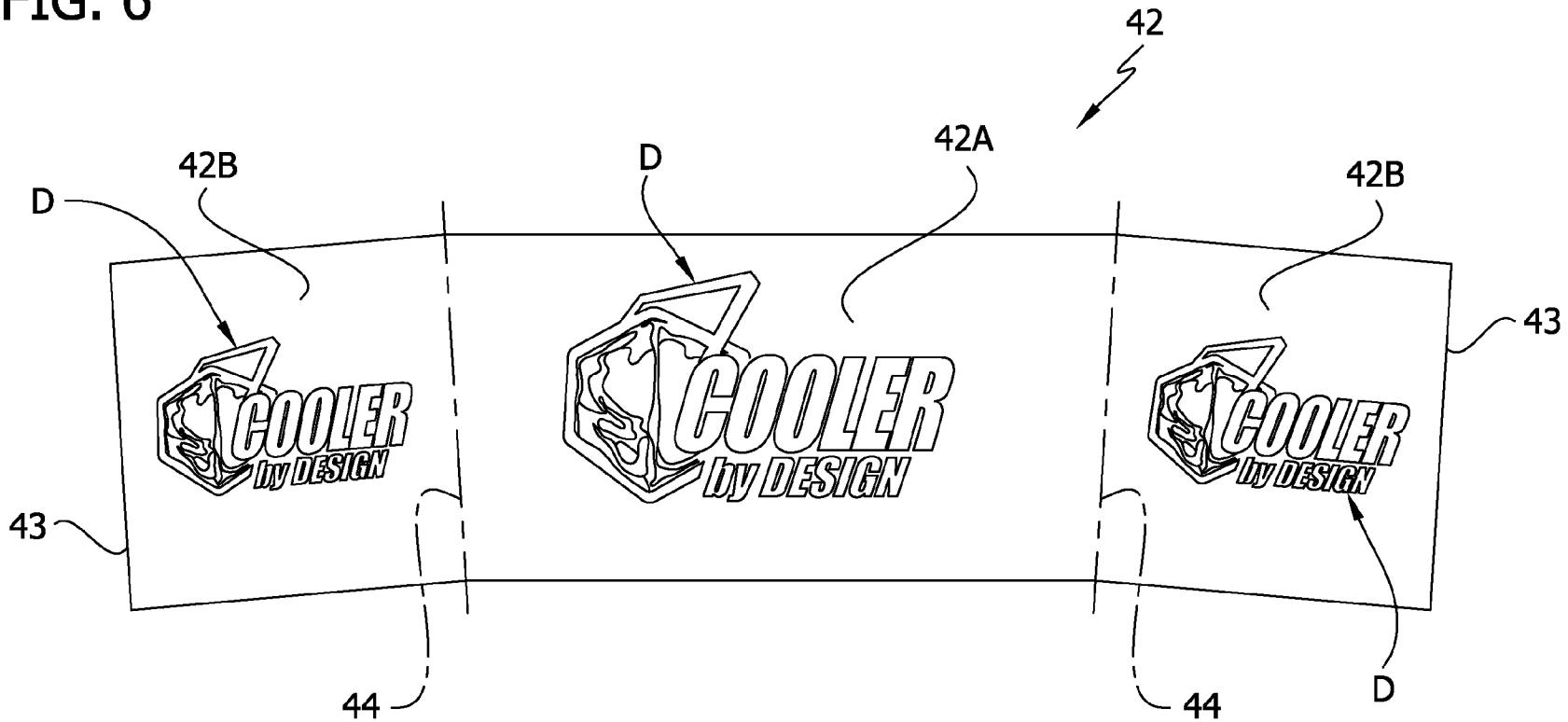
FIG. 6 is a plan view of a design panel layout forming a part of the invention.

Referring particularly to FIGS. 2A and 3, the exterior front and both end side walls 14, 18 of the cooler body B are configured with a continuous display zone constituting a wide central recessed channel 40 having upper and lower horizontal margins 40A and 40B and being constructed and arranged to seat a design panel system P that will wrap-around the cooler body B. The design panel system may include a vinyl sheet 42 that is surface imprinted with the selected design or motif, although other materials may be used. For instance as described more fully hereinafter, in lieu of simply surface printing the vinyl sheet 42 as a single ply design panel, this panel 42 may have an inner ply that is printed or painted with a design (e.g., design D of FIG. 2A) on its outer surface and the inner surface will be attachable to the cooler body B in the design zone of the side wall. The vinyl sheet 42 is flexible and will naturally tend to cling to the side walls (14, 18), but will usually be attached in a suitable manner such as with an adhesive. The vinyl sheet 42 is composed of a front section 42A and two end sections 42B, as shown in FIG. 6, and fits in the design zone of the central recess 40 of the cooler body.

As also shown in FIGS. 2A and 3 a hard transparent outer shield or cover member 50 may form part of the design panel arrangement P and is constructed and arranged to fit over the design panel 42 and also reinforce and strengthen the front and end side walls 14, 18. The cover member 50 has front and end panel sections 50A, 50B corresponding to the same sections 42A, 42B of the design panel 42 and the cover member 50 is configured to fit within the channel 40 and be secured to the body therein. The outer cover member 50 is preferably made of acrylic plastic, and it preferably has a thickness gauge that together with the inner design panel 42 corresponds to the depth of the side wall channel 40 whereby the outer cover member 50 will be substantially flush with the outstanding front and end side wall surface portions at the top and bottom of the cooler body B. One method of securing the outer cover member 52 to the cooler body B is to provide integral upper and lower tabs 56A, 56B at the rearward margins 58 of the cover member 50 to receive anchoring screws or pins 60 to fasten into corresponding tapped anchor points on the end side walls 18. It will be apparent that the cover member 50 not only protects the design panel 42, but also strengthens the cooler body walls. It will again be noted that the rearward free margins 43 of the inner design panel 42 and rearward margins 58 of the outer protective cover 50 are positioned adjacent to the rear wall 16 thereby providing an almost total design spectrum around the cooler C. In another embodiment to be described one or both of these margins may be extended further to wrap-around onto the rear wall 16. Thus it is clear that the inventive cooler incorporates a design panel having multiple plies or layers applied to gird the main body B and both protect it and offer a broad wrap-around design potential.

The preferred form of the cooler C is to give the exterior body B a tapered look with the result that at least one section of the design panel (42) and/or wrap-around cover member 50 has a trapezoidal shape. The front side wall has parallel top and bottom margins with downwardly converging vertical edge sections (shown generally at 44 in FIG. 6). The geometry is complex because in the instant cooler the end side walls 18 are also trapezoidal being longer at the top and smaller at the bottom. FIG. 6 represents a layout blank for the vinyl sheet 42 configuration. Thus, the central or front-facing side panel section 42A is flanked by the end side panel sections 42B that are angularly disposed to the central section. When assembled on the main body channel 40 the angularity of these sections will compensate for the taper at the side walls to produce a straight line wrap-around panel accommodating a continuity of design from side to side.

Figure 8:
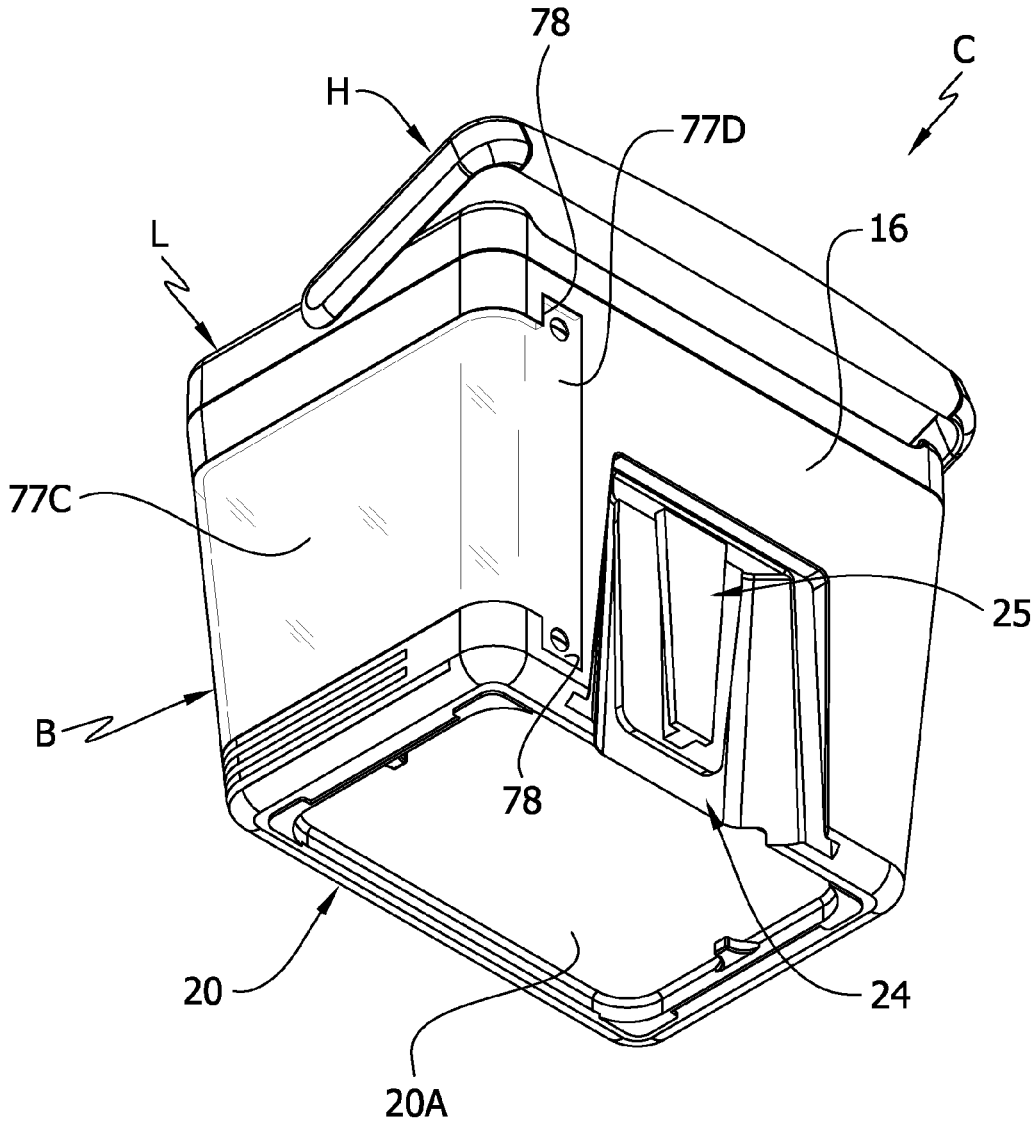
FIG. 8 is a rear and bottom perspective view of the cooler body of FIG. 7.
Figure 9:
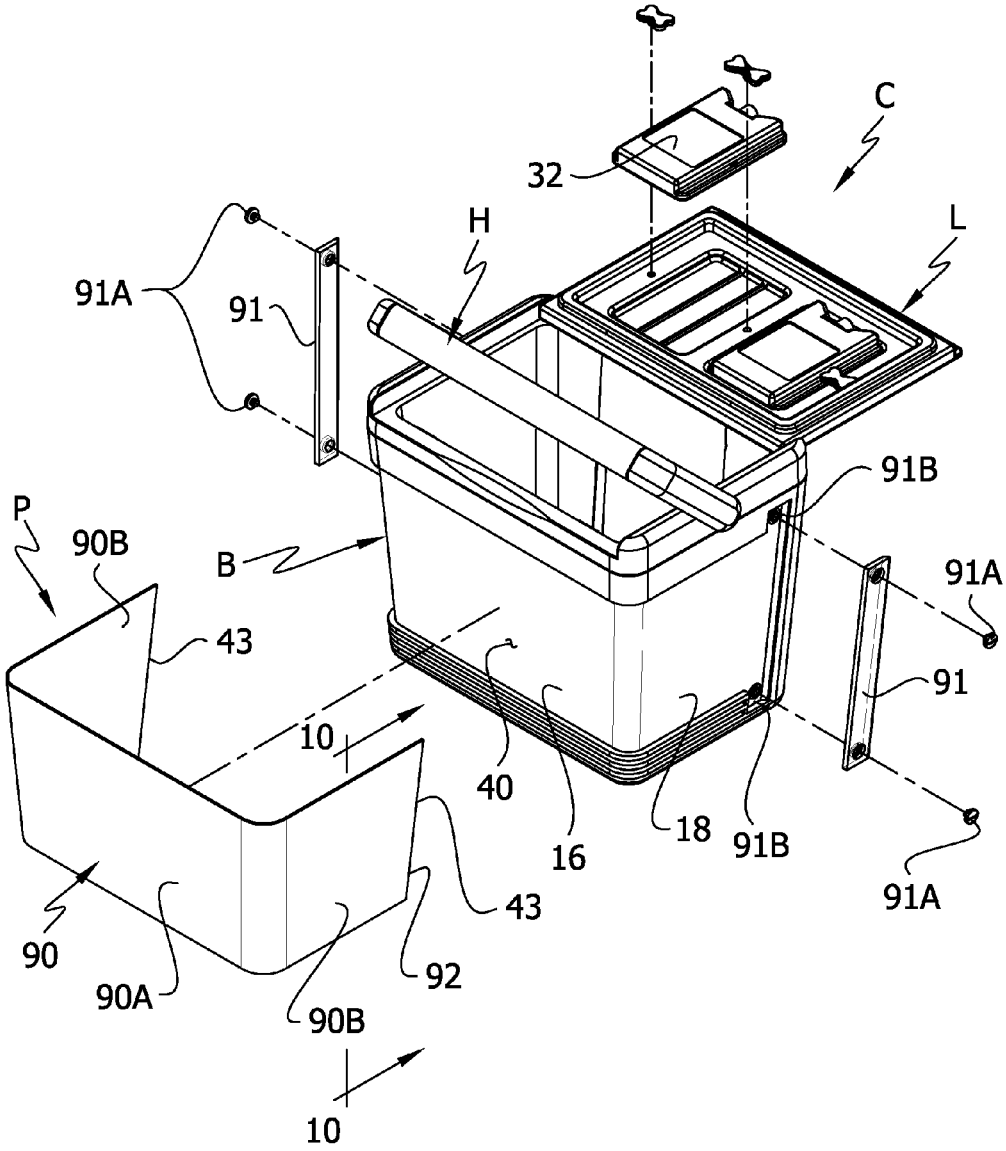
FIG. 9 is an exploded perspective view showing a third embodiment of the cooler invention.

Referring to FIGS. 8 and 9, a second embodiment of the cooler C includes a two ply design panel 46 that fits within the design zone of recessed channel 40 in substantially the same way as the single ply vinyl sheet of the first embodiment. In this embodiment the design panel 76 has a front side wall section 76A with a wrap-around flap 76B at one vertical marginal edge; and it has a continuous end side wall section 76C at its other vertical marginal edge. The end side wall section 76C has a wrap-around flange 76D that wraps around to the rear side wall 16 of the cooler. A transparent cover member 77 is applied over the design panel 76 as part of this system and includes a front side wall section 77A with a wrap-around flange 77B at one vertical margin, and its other margin has a contiguous end side wall section 77C, with a rear flange 77D to fit into an extended side wall channel. These flanges 77B and 77D may have upper and lower anchoring tabs 78 which are secured to the cooler body in a suitable manner, such as with fasteners. It is also contemplated that the vinyl sheet and/or the cover member can be constructed and arranged to overlay and wrap around all four sides of the cooler to present an entire panoramic display and/or guard all sides of the cooler (not shown). The downward and inward taper of the cooler body accommodates a slip-over wrap. The vinyl sheet and cover may extend over fewer than three sides of the cooler, as shown.

Figure 10:
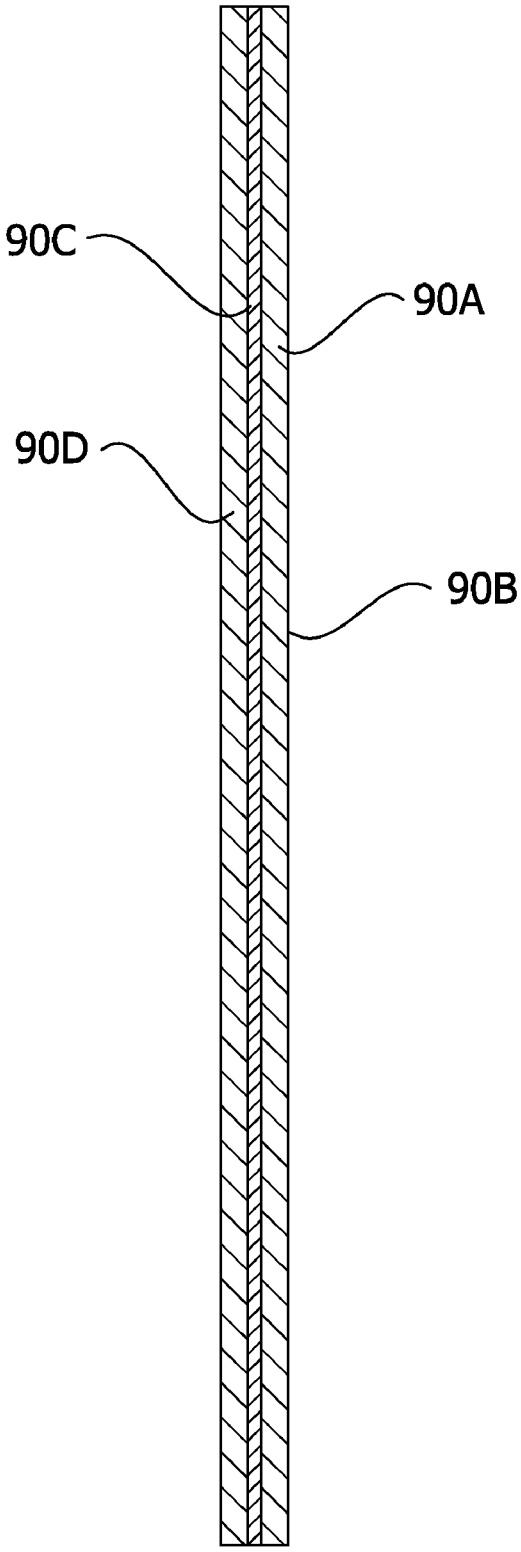
FIG. 10 is a greatly enlarged section similar taken in the plane including line 10-10 of FIG. 9.

In yet another embodiment shown in FIG. 10, the design panel system P comprises a two ply vinyl panel 90. The panel 90 includes an outer ply 90D of transparent vinyl material that is laminated onto an inner ply 90A of vinyl or other suitable material. The panel 90 is preferably of substantive thickness yet flexible. The lamination of the inner and outer plies 90A, 90D may be carried out by a special lamination process to strengthen the panel in addition to increasing the depth of design and artistic enhancement to the cooler. The design panel 90 is received in the design zone of channel 40 of the cooler C, but does not employ a separate cover member like the cover member 50 of the first embodiment The inner ply 90A has an adhesive bearing inner attachment surface 90B and an outer design-bearing surface with an image represented by a design layer 90C. The transparent outer shielding ply 90D covers the design layer 90C to protect the design layer. The plies 90A, 90D are laminated together in this embodiment and form a design panel system P to be attached in the design zone of the designated cooler side wall. The lamination process can be by 3M Company and called "sublimation". It will also be apparent now to those skilled in the art that the two ply system provides the basic foundation for applying the design display motif and may be shielded by an outer cover. The number of plies forming the panel may be other than one or two within the scope of the present invention. Moreover, the process for forming the design panel 90 may be other than described without departing from the scope of the present invention.

Figure 7:
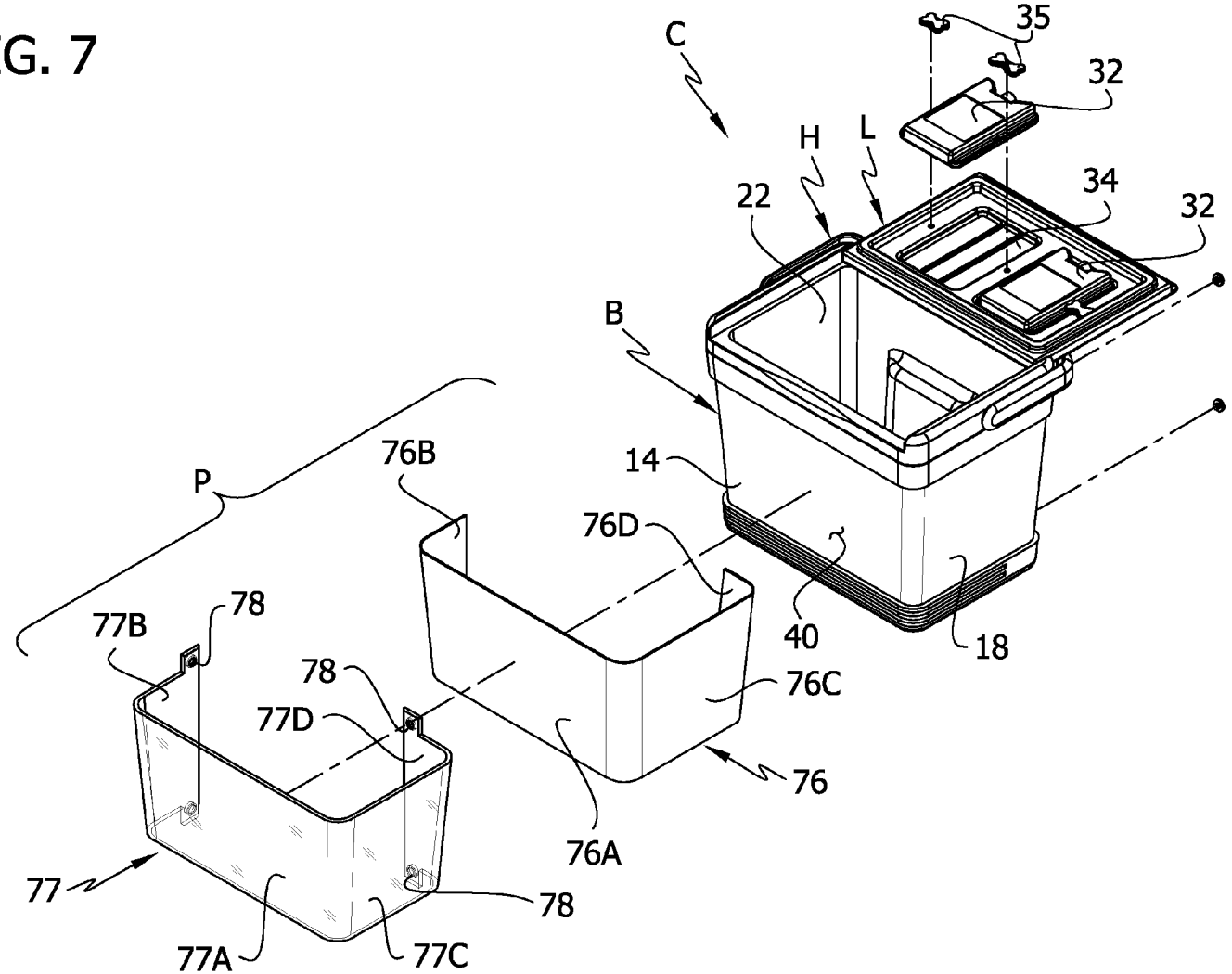
FIG. 7 is an exploded perspective view showing a second embodiment of the invention.

The free vertical end margins 43 (see, FIG. 9) will lay adjacent to the cooler rear wall 14 and are guarded by an overlying shield which in the illustrated form comprises a vertically arranged guard strip 91 that is fastened to the body B in overlapping relation with the marginal edge of the design panel 90 by fasteners 91A. The recessed channel 40 including the design zone is notched (at 91B) upwardly and downwardly to accommodate the ends of the shielding strip 91. The strips 91 form part of the design panel system P in this embodiment. It will be understood that other shielding strips (not shown) may be applied to guard other marginal edges or an entire transparent cover panel (such as acrylic cover 50 of FIG. 2A or 77 of FIG. 7) may be used to provide a hard surface exterior shield for the design panel system P.

FIG. 2B shows another version in which a design D is formed on the transparent cover member 50' and the vinyl sheet 42 of the first embodiment is omitted. More particularly, the design D may be formed in a suitable manner on an interior surface of the cover member 50'. In this version, the design panel system P is formed by the cover member 50' alone. Parts of the version shown in FIG. 2A that are the same as the first embodiment are given the same reference numerals. The cover member 50' and its component parts are given the same reference numerals with the addition of a prime.

Figure 11A:
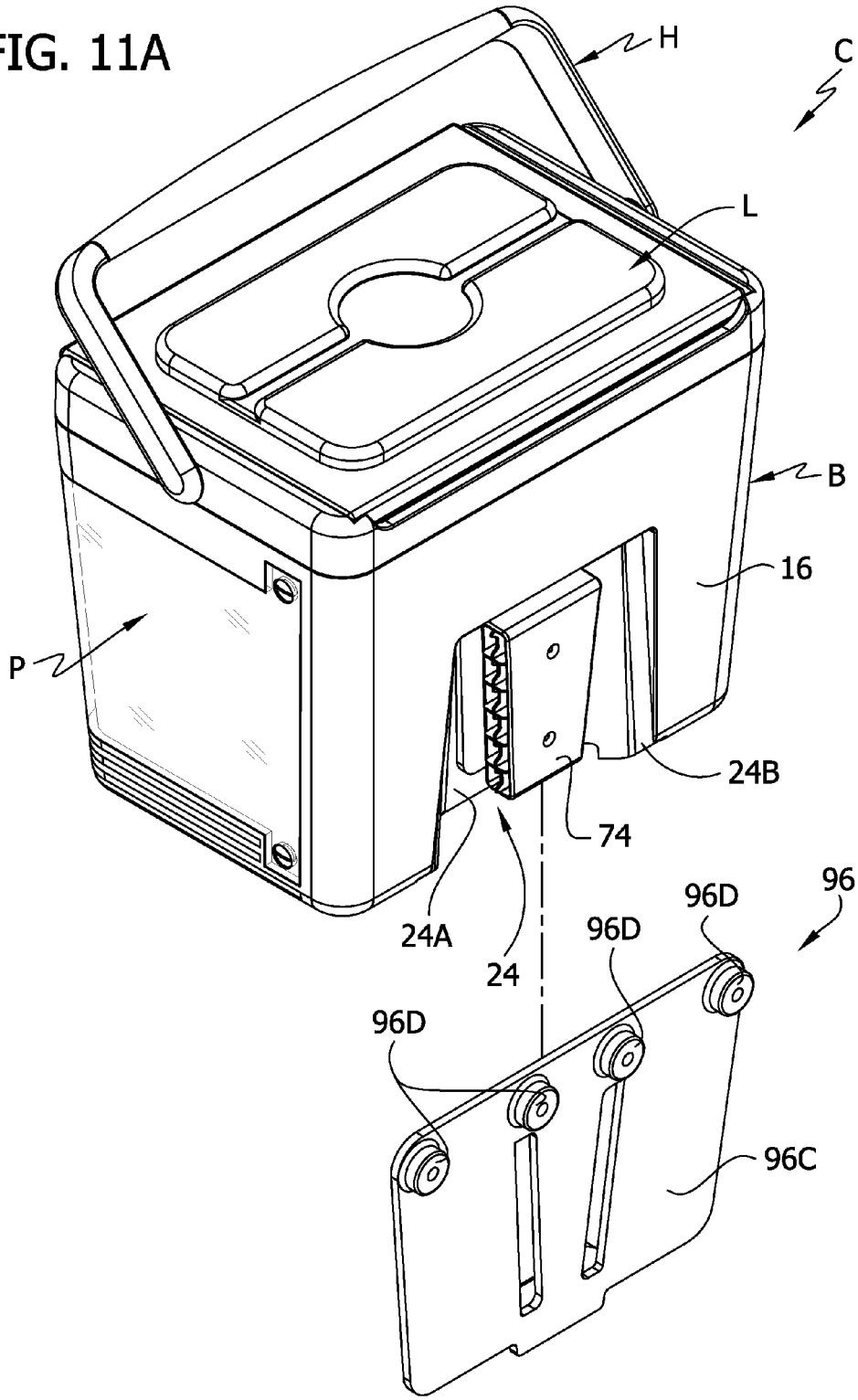
FIG. 11A is a perspective view similar to FIG. 5 showing the bracket adapter assembled on the rear cooler wall and a wall mounting bracket in exploded position to receive the cooler.
Figure 11B:
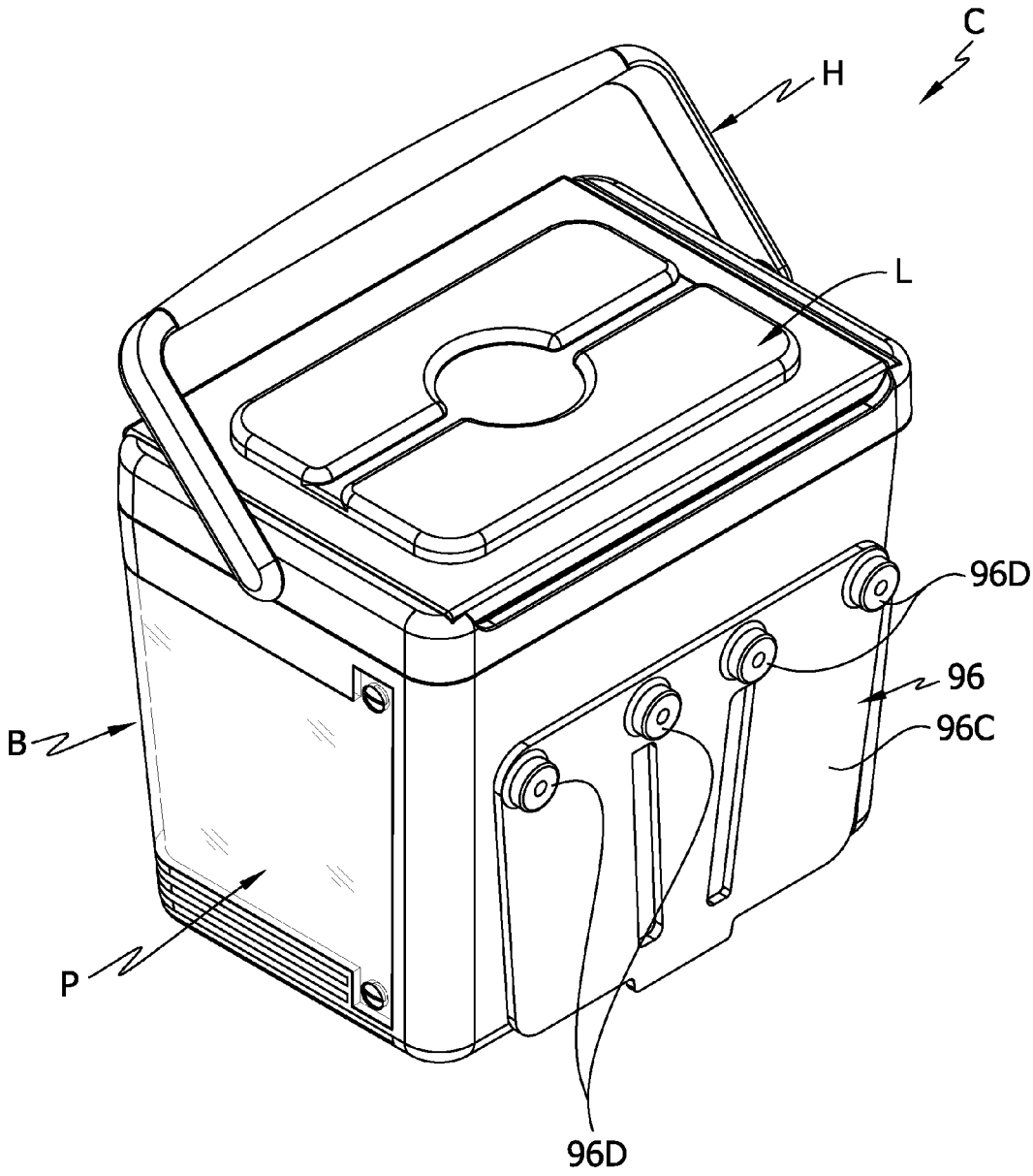
FIG. 11B is a view showing the cooler positioned on the wall mounting bracket of FIG. 11A.

FIGS. 11A, 11B, 12A, 12B, and 13 best show another feature of the invention, which is to provide the cooler-mounting system for removably mounting the cooler C on any type of vehicle for convenient access to the driver or a passenger, or it may be mounted to some other structure that may or may not be associated with a vehicle. FIGS. 11A-12B particularly show adaptation of the mounting system for attaching the cooler C to a wall or any generic structure. FIG. 11A is similar to FIG. 5, except that the mounting adapter 74 thereof shown in exploded position from the cooler C is received on the cooler mounting block 25 and covers the mounting block. The mounting adapter 74 is shaped to define angled slots 74A (see FIG. 50 that receive the side rails 25B of the mounting block to mount the adapter onto the cooler rear wall 16. Opposite lateral edge margins of the adapter 74 are angled in a manner similar to the rails 25B of the cooler mounting block 25. The adapter 74 projects outwardly from the mounting block 25 in the chamber 24 so that it is essentially flush with the remainder of the rear wall 16.

Figure 12A:
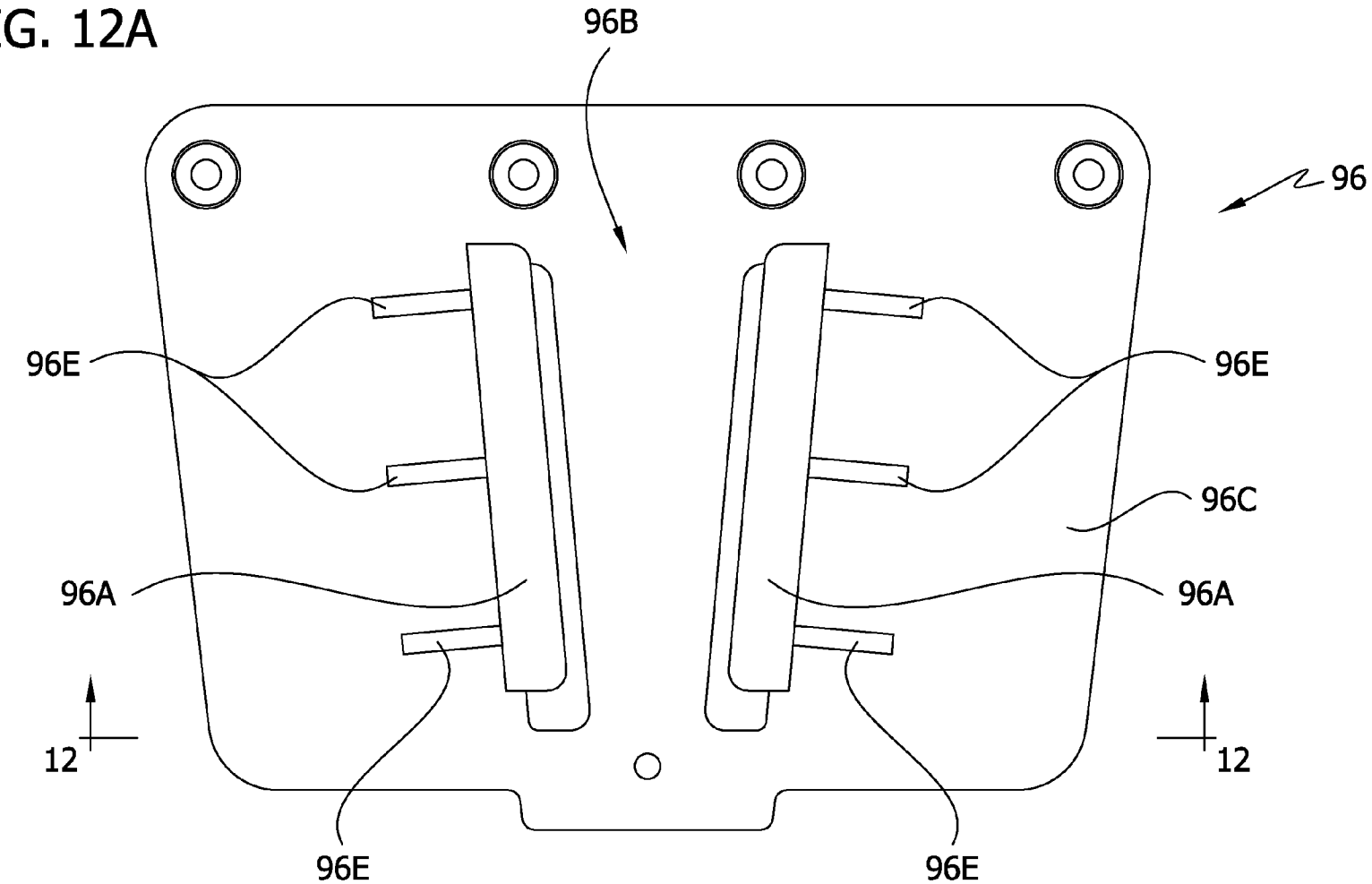
FIG. 12A is an elevational view of the wall mounting bracket of FIGS. 11A and 11B.
Figure 12B:
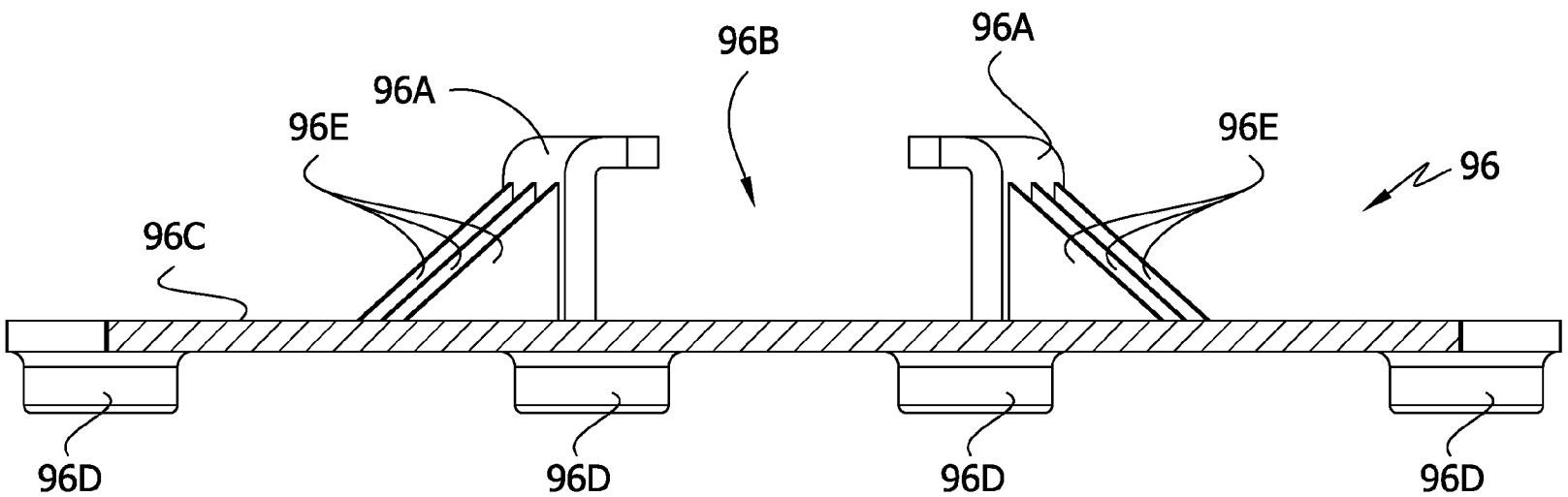
FIG. 12B is a sectional view of the bracket taken along line 12B-12B of FIG. 12A.

A generic mounting bracket 96 (broadly, "a second bracket"), shown by itself in FIGS. 12A and 12B, has opposed, angled channel members 96A that define a wedge-shaped opening 96B between them. The opening 96B is sized and shaped to receive the side rails of the adapter 74 into the opening with the edge margins or rails of the adapter being captured by the channel members 96A. The mounting bracket 96 has a main plate 96C with wall mounting spacer studs 96D that space the channel members 96A a sufficient distance from the wall surface or other mounting surface to accommodate the rearward folding of the handle H. The adapter-holding channel member 96A is secured to the main plate 96C by plural strengthening gussets 96E. The channel members 96A may be formed in any suitable manner, such as by being struck from, but unitary with the main plate 96C, and may be reinforced with gussets the 96E or other structure.

Figure 13:
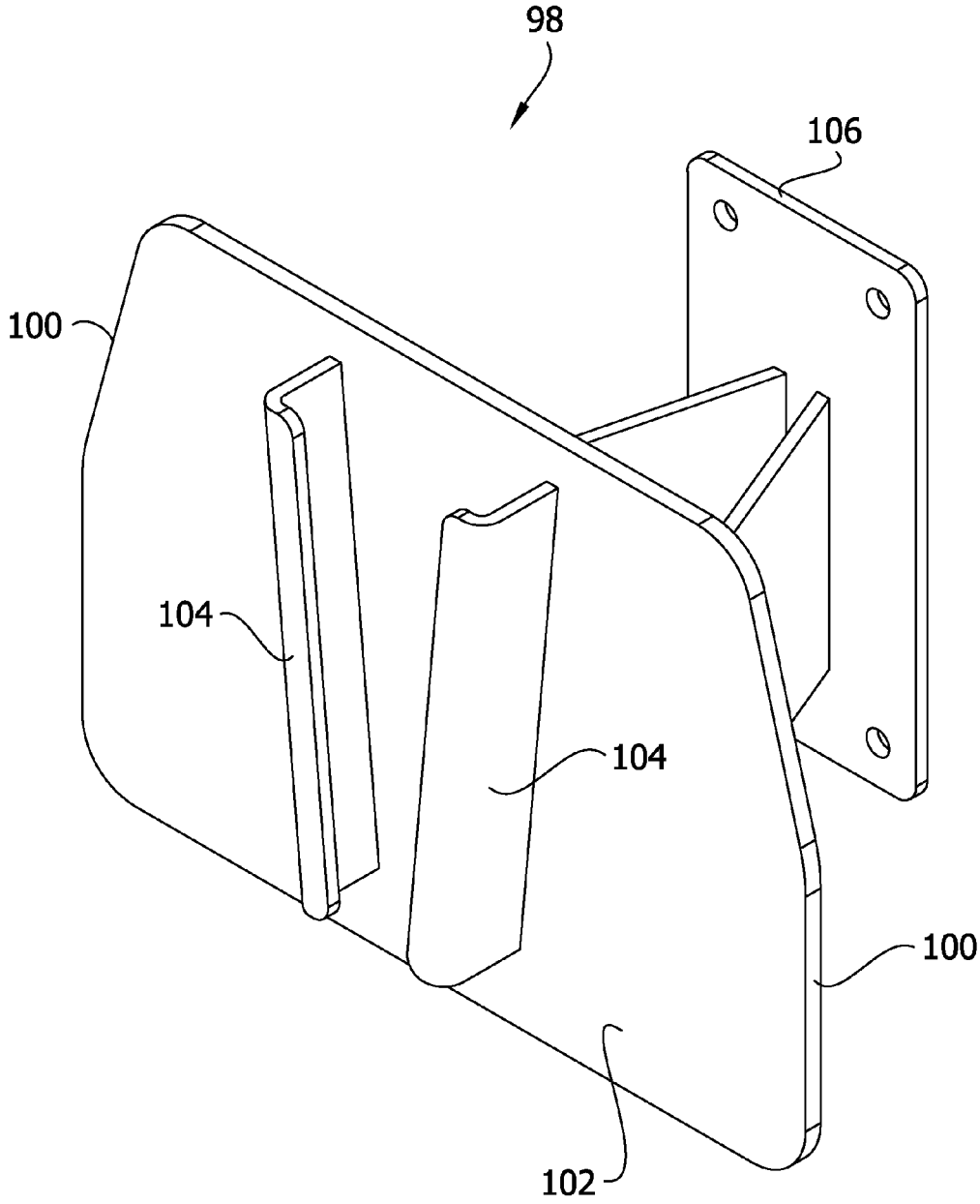
FIG. 13 is a greatly enlarged view of another form of mounting bracket for the cooler.
Figure 14A:
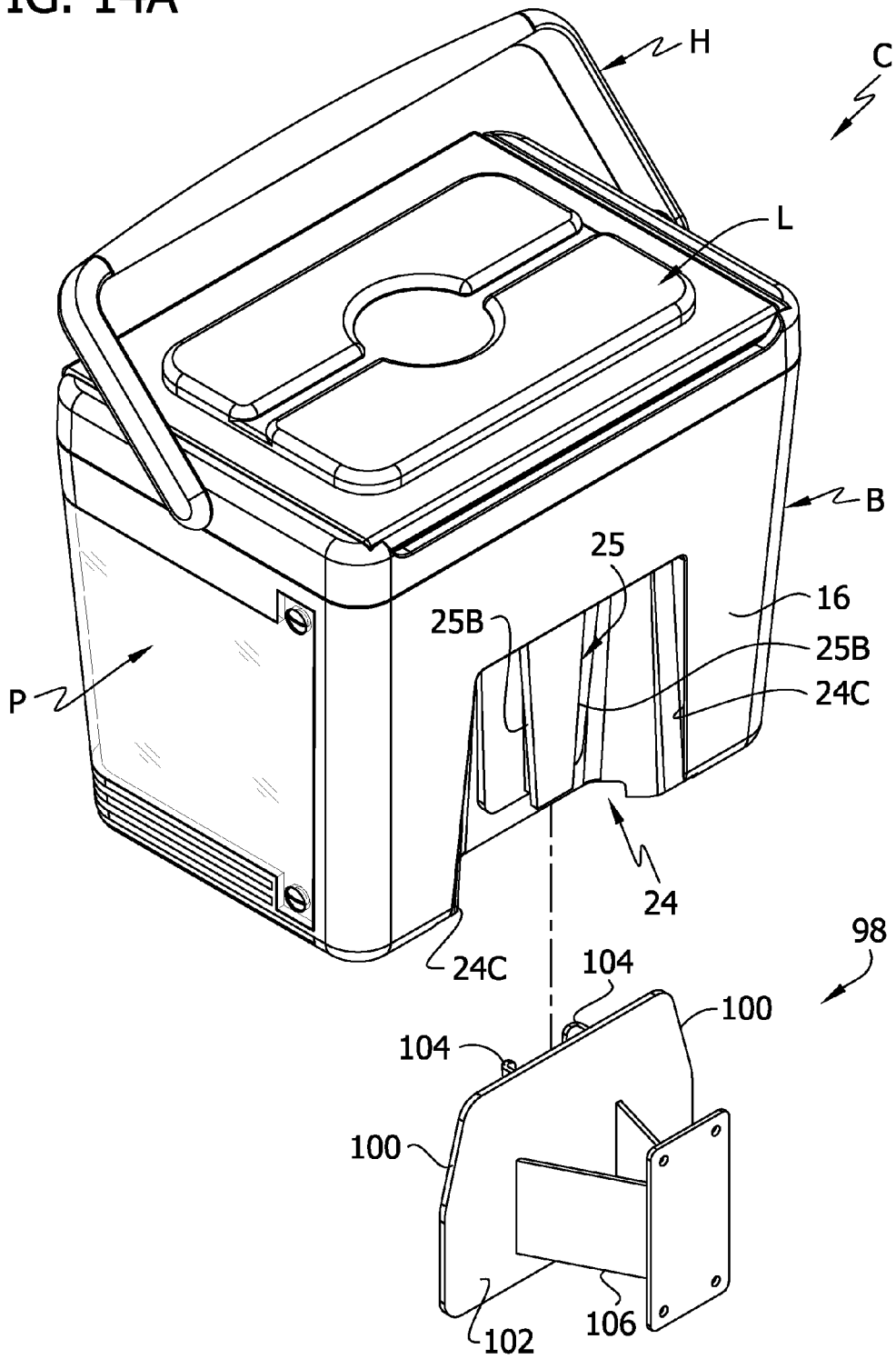
FIG. 14A is a rear perspective view of the first cooler embodiment shown with the bracket of FIG. 13 in an exploded position.
Figure 14B:
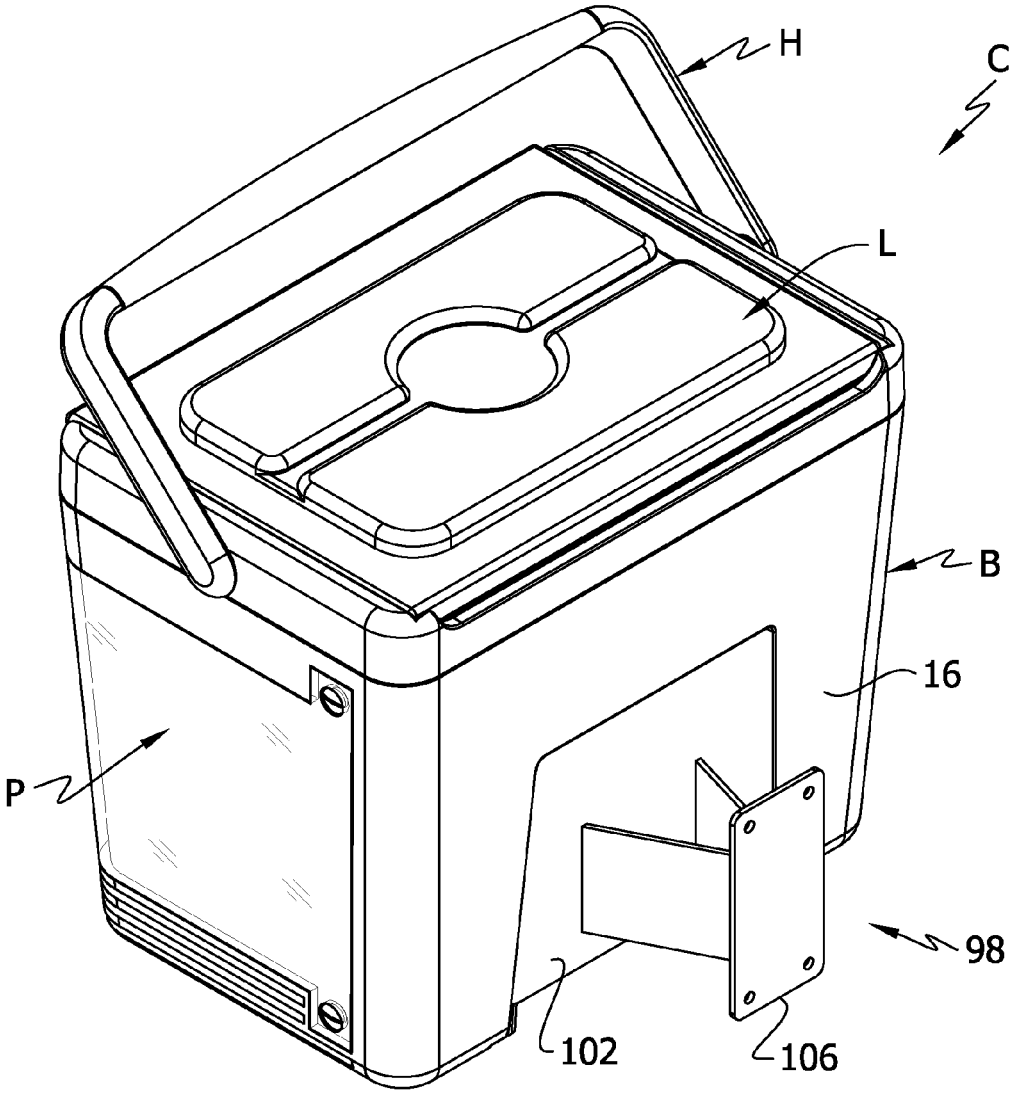
FIG. 14B is a view similar to FIG. 14A, but showing the mounting bracket on the cooler.

Referring now to FIGS. 13, 14A and 14B, a ("first") mounting bracket 98 may be constructed and arranged so that its outer vertical edges 100 can be received in the peripheral channels 24C of the recessed chamber 24 on the rear wall 16 of the cooler C, as is shown in FIG. 14B. The mounting bracket 98 includes a main plate 102 and angled retainer members 104 secured to one face of the plate. The retainer members 104 are configured to receive the mounting block 25 and be captured under the rails 25B (see, FIG. 13). It will be understood that the retainer members 104 are received on the mounting block 25 and the edges 100 are received in the channels 24C substantially simultaneously as the mounting bracket 98 is moved upward from the position shown in FIG. 14A to the secured position shown in FIG. 14B. The mounting bracket 98 further includes a mounting arm 106 for attachment to another structure (e.g., to a golf cart body). The mounting arm 106 is attached to the main plate 102 on the opposite side from the retainer members 104. Only a generic mounting arm 106 is illustrated, as the mounting structure on this side of the main plate 102 may have any suitable structure for mounting to another object. Preferably, the weight of the cooler C is sufficient to maintain the connection shown in FIG. 14B, but fasteners (not shown) could be used to secure it in place.

Figure 15:
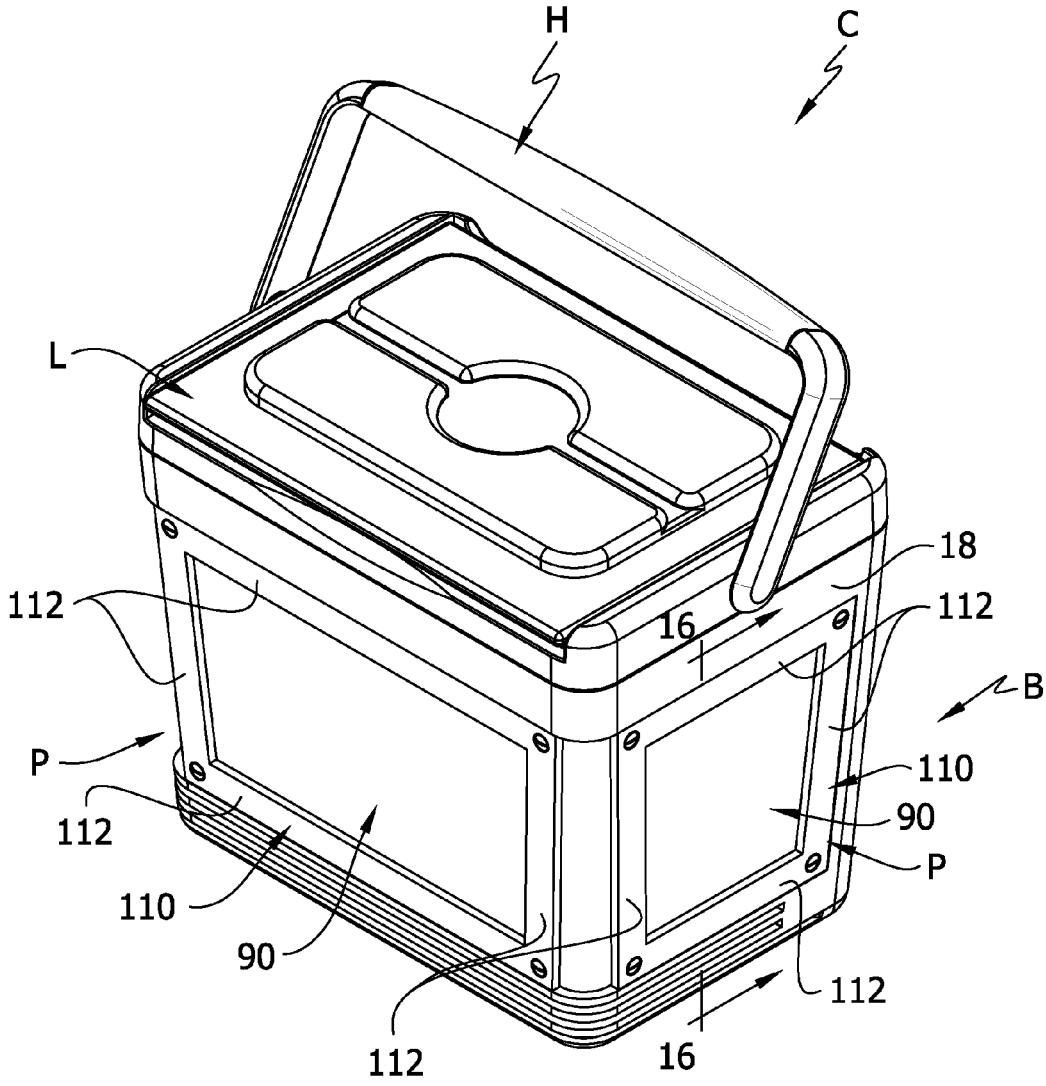
FIG. 15 is a front perspective view of the cooler showing another embodiment of the invention.
Figure 16:
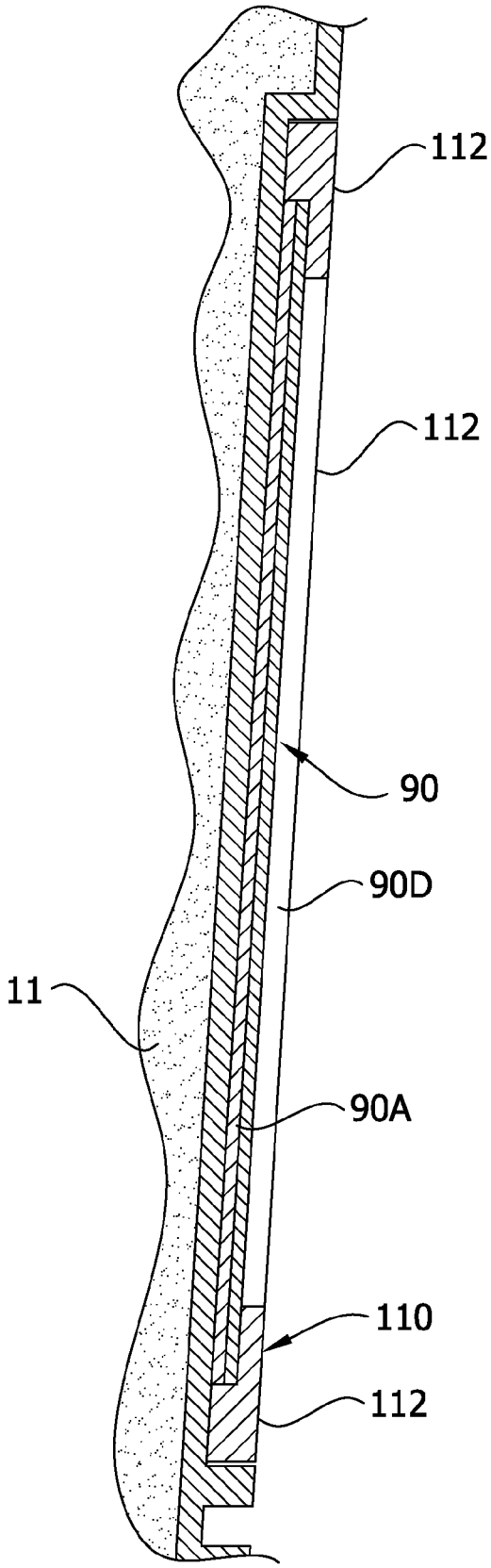
FIG. 16 is a cross-sectional view taken along line 16-16 of FIG. 15.

In FIGS. 15 and 16 the cooler C has multiple contiguous front, end and rear side walls (14, 18, 16), a bottom (20) that is integral with the side walls to form a product chamber and a hinged lid L. The side walls each have an optimum surface area providing a design zone for graphic presentation, that may be in any of the multiple layer design panel (42, 90) formats herein described, and which may be further enhanced by an outer shield in the form of a frame 110 constructed and arranged to cover and protect at least a portion of the underlying design panel, such as one or more marginal edges. Thus, in the FIG. 15 embodiment the cooler is shown with multiple strips 112 forming a frame protection for edges on a single side wall design. The strips 112 may be integral, as shown, or be two or more separate parts attached to the cooler. In this embodiment, the design panel 90 and frame 110 form a design panel system. It will be understood that continuous horizontal frame piece may be employed to wrap-around the corner between adjacent side walls displaying a wrap-around design panel P. It will also be seen that the frame 110 may be a wrap-around panel (50) or a partial protective cover plate such as frame 110 depending in part upon the form of the underlying design panel system utilized. For instance, in the use of a two-ply design panel system having a heavy protective outer ply (45), the frame work of FIGS. 15 and 16 may be adequate to guard the inner design ply (see FIG. 10). It is to be understood that only one side wall of the cooler may have a design panel system P, or any number of the side walls may have a design panel system in the scope of this invention.

An insulated cooler C of the illustrated embodiments is portable but incorporates a variable mounting system making it useful in various vehicles and fixed locations for convenient storage of refrigerated or heated products. The cooler C also achieves the objectives of stackability and comfort in handling. One feature of the invention is the design display potential of multiple sided design and the selective use of a multiple ply design panel system.

Having described the invention in detail, it will be apparent that modifications and variations are possible without departing from the scope of the invention defined in the appended claims.

What is claimed is:

1. An insulated cooler comprising:

a main cooler body having multiple side walls and a bottom wall forming a product container with a top opening;

a lid constructed and arranged for selectively covering the top opening;

at least two of said multiple side walls being adjacent to each other, and each of said adjacent side walls having a design zone thereon; and a design panel system having an inner side design portion overlaying the side wall design zone and an outer side portion comprising a protective shielding cover for the inner side design portion.

2. The insulated cooler of claim 1, in which the design panel system comprises a two-ply design panel including an inner ply forming the inner side design portion thereon.

3. The insulated cooler of claim 2, in which said inner ply has an inner attachment surface positioned in the display zone of a side wall and an outer design-bearing surface, and said design panel system comprises a separate outer cover ply shielding at least a part of said inner ply.

4. The insulated cooler of claim 3, in which said outer cover ply is transparent and is constructed and arranged to cover the entire inner ply in the design zone of the cooler.

5. The insulated cooler of claim 1, in which said multiple side walls comprise opposed front and rear side walls connected by end side walls, said front side wall being contiguous with both end walls, and wherein said design panel system comprises a design panel arranged to continuously cover at least two of the contiguous side walls.

6. The insulated cooler of claim 1, in which said lid is formed of outer and inner shells with foamed insulation therebetween, said inner shell being constructed and arranged with a recessed pocket for accommodating a frozen coolant packet therein, and a latch for releasably holding the coolant packet in said recessed pocket.

7. The insulated cooler of claim 6, in which the latch comprises bowtie fasteners, and at least two of the bowtie fasteners being arranged to hold each side of the coolant packet.

8. The insulated cooler of claim 1 in which one of the side walls includes a bracket mount constructed and arranged for releasable mounting on a bracket.

9. The insulated cooler of claim 8, in which the bracket mount includes a recessed chamber in said one side wall, the bracket mount being adapted to mount a first bracket received entirely within the recessed chamber.

10. The insulated cooler of claim 9, in which the bracket mount is adapted for mounting a second bracket that engages at least a portion of said one side wall around the recessed chamber.

11. The cooler as set forth in claim 10 wherein the bracket mount includes a removable adapter for use in mounting said second bracket.

12. The cooler as set forth in claim 9 wherein the bracket mount includes a generally central mounting track in the recessed chamber and a peripheral channel adapted to receive a peripheral edge margin of the first bracket in the recessed chamber.

13. An insulated container comprising:

a main cooler body having side walls and a bottom wall forming an internal container cavity for holding products;

a lid to selectively enclose the container cavity;

at least one of said side walls having a design zone thereon;

a design panel overlaying the side wall design zone the design panel being affixed to one of the side walls of the container, the design panel having a design thereon;

a guard strip mounted on the container, the guard strip being elongate and having opposite free ends, the guard strip having opposite longitudinal sides extending between the free ends and having transverse sides extending between the longitudinal sides at the free ends the transverse sides being shorter than the longitudinal sides, the guard strip covering an edge margin of the affixed design panel.

14. The insulated container of claim 13 wherein the side wall has a recess receiving the design panel and guard strip.

15. The insulated container of claim 14 wherein the guard strip has an outer surface that is generally flush with a portion of the side wall adjacent to the recess.

16. The insulated container of claim 13 wherein the design panel is affixed to at least two of the side walls of the container and the side walls have a recess extending continuously from one of the side walls to the other of the side walls, the recess receiving the design panel and guard strip.

17. The insulated container of claim 14 wherein The recess includes notches sized and shaped to accommodate ends of the guard strip extending beyond the edge margin of the design panel.

18. The insulated container of claim 13 wherein the design panel is attached by an adhesive to said at least one side wall of the container.

19. The insulated container of claim 13 wherein the guard strip is mounted on a side wall of the main cooler body, the guard strip covering a free vertical end margin of the design panel, the guard strip extending vertically along the side wall, the guard strip being positioned between and spaced from opposite left and right vertical edges of the side wall.

* * * * *